US009457936B2

(12) United States Patent
Curtin

(10) Patent No.: US 9,457,936 B2
(45) Date of Patent: Oct. 4, 2016

(54) ACCESS STRUCTURE

(71) Applicant: Illinois Tool Works Inc., Glenview, IL (US)

(72) Inventor: Willow Curtin, Crystal Lake, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/669,355

(22) Filed: Mar. 26, 2015

(65) Prior Publication Data

US 2015/0197376 A1 Jul. 16, 2015

Related U.S. Application Data

(63) Continuation of application No. PCT/US2013/059683, filed on Sep. 13, 2013.

(60) Provisional application No. 61/971,757, filed on Mar. 28, 2014, provisional application No. 61/701,289, filed on Sep. 14, 2012.

(51) Int. Cl.

*B65D 33/02* (2006.01)
*B65D 33/34* (2006.01)
*B65D 77/06* (2006.01)

(52) U.S. Cl.

CPC ..... *B65D 33/02* (2013.01); *B65D 33/34* (2013.01); *B65D 77/065* (2013.01); *B65D 77/067* (2013.01); *B65D 77/068* (2013.01)

(58) Field of Classification Search

CPC .... B65D 33/34; B65D 33/02; B65D 77/065; B65D 77/067; B65D 77/068; B65D 77/062; B65D 77/06; B65D 37/00; B65D 11/08; B65D 25/005; B65D 25/14; B65D 51/226; B65D 51/221; B65D 51/22; B65D 5/748; B65D 5/747; B65D 5/746; B65D 5/74; B65D 5/72; B65B 43/262; B65B 1/18; B65B 7/16; B65B 7/28

USPC ..... 220/278, 277, 265, 495.05, 9.4, 495.06, 220/495.03, 495.01, 23.86, 23.83, 601, 220/661; 229/117.31, 117.3, 117.27; 383/5, 383/200, 202; 53/469, 471, 467, 492

See application file for complete search history.

(56) References Cited

U.S. PATENT DOCUMENTS

| | | | | | |
|---|---|---|---|---|---|
| 3,173,579 | A * | 3/1965 | Curie | B65D 47/283 | 222/105 |
| 3,206,075 | A * | 9/1965 | Scholle | B67D 3/045 | 222/105 |
| 4,322,018 | A * | 3/1982 | Rutter | B65D 47/263 | 222/105 |
| 4,351,455 | A * | 9/1982 | Bond | B65D 47/283 | 222/153.05 |
| 4,421,253 | A * | 12/1983 | Croley | B65D 77/061 | 206/386 |
| 4,475,670 | A * | 10/1984 | Rutter | B65D 77/067 | 222/105 |
| 2013/0119061 | A1* | 5/2013 | Smith | B65D 43/0235 | 220/265 |

FOREIGN PATENT DOCUMENTS

| | | | | |
|---|---|---|---|---|
| DE | 3233881 A1 * | 4/1984 | ..... | B65D 88/16 |

* cited by examiner

*Primary Examiner* — Robert J Hicks

(57) ABSTRACT

An access structure for a bag container includes a stress riser configuration formed in the bag and an attachment body attached to the bag overlying the stress riser configuration. A probe that may be associated with a shut off is provided for insertion through the attachment body and against the stress riser configuration to rupture the stress riser configuration and open the bag for emptying.

18 Claims, 11 Drawing Sheets

ACCESS STRUCTURE

CROSS REFERENCE TO RELATED APPLICATIONS

The present application claims the benefits of U.S. Provisional Application Ser. No. 61/971,757 filed on Mar. 28, 2014; and is a continuation of PCT Application US2013/059683 filed Sep. 13, 2013, which claimed the benefits of U.S. Provisional Application Ser. No. 61/701,289, filed on Sep. 14, 2012.

FIELD OF THE INVENTION

The present invention relates generally to bag in a box assemblies, and to the access structures through which valves, probes and other devices are inserted for removing the contents from the bag. More particularly the present invention relates to hermetic seals for such access structures.

BACKGROUND OF THE INVENTION

So-called bag in a box containers and other bag-like containers are used for transporting and dispensing flowing contents of many types. In one type of known structures, a flexible bag-shaped membrane is provided with an access location through which a valve, probe or other structure can be attached or inserted for removing the contents from the bag by gravity, pumping or other induced extraction. In another type of known structures, the flexible bag is simply slashed or ruptured and the content spilled there from. It is known to use such containers for flowing contents of many different types, including food products that must be hermetically sealed to prevent contamination and spoilage in addition to preventing leakage.

In some uses for bag in box containers, a valve, probe or other removal control structure is inserted through the access location of the bag and remains positioned therein until the content of the bag is completely removed. In other uses for bag in box containers, such as, for example, dispensing beverage mixes, condiments or the like at a food serving establishment, mandatory cleaning schedules for the dispensing equipment may require that the valve or probe be removed from the access location in the bag when the dispensing equipment is to be cleaned. After cleaning, the probe, valve or the like is reinserted through the access location. Accordingly, it is desirable to have an access location that prevents leakage before first use, that seals completely around the valve, probe or other extraction equipment inserted therethrough during use, that will close completely if the valve, probe or other access equipment is removed, and that accommodates reinsertion of the valve, probe or other access equipment. When used for food products, it is desirable that the access location is tamper-proof, or at least tamper indicating so that one can readily determine if the closure at the access location has been compromised.

Known structures for the access locations of bag in box containers have been multi-component assemblies, which have been known to include a die cut membrane and a snap ring assembled to a housing structure welded or otherwise secured to the bag. Such snap together assemblies can disassemble under pressure, can leak if the component parts are miss-cut or assembled improperly, and do not provide a hermetic seal. Accordingly, there is a need for improved access location structures for bag in box containers. Desirably, the access location structures are of single piece construction and hermetically sealed, and accommodate removal and reinsertion of a probe, valve or other extraction structure used for removing the content of the bag. Improved indicators of tampering also are desirable.

SUMMARY OF THE INVENTION

The access structure for a bag in a box container described herein provides a one-piece structure that is hermetically sealed before use by forming the structure using different materials in an overmolding process, with a foil seal attached thereto. The structure allows the opening to re-close if extraction equipment is removed. Tamper evident features can be incorporated into the structure.

An advantage of a form of the access structure disclosed herein is providing a hermetic seal for a bag container prior to first use.

Another advantage of a form of the access structure disclosed herein is that the bag container on which the structure is used can be removed from dispensing equipment and the access structure will reclose.

Other features and advantages of the invention will become apparent to those skilled in the art upon review of the following detailed description, claims and drawings in which like numerals are used to designate like features.

BRIEF DESCRIPTION OF THE DRAWINGS

FIG. 8 is a plan view of the outside of yet another embodiment for an access structure for a bag in a box container;

Figure 1:
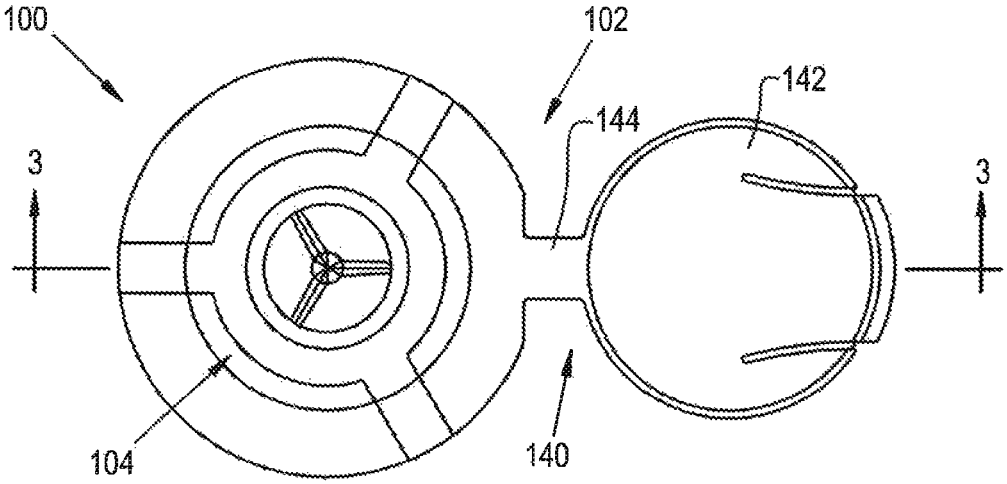
FIG. 1 is a plan view of the outside of an access structure for a bag in a box container.
Figure 2:
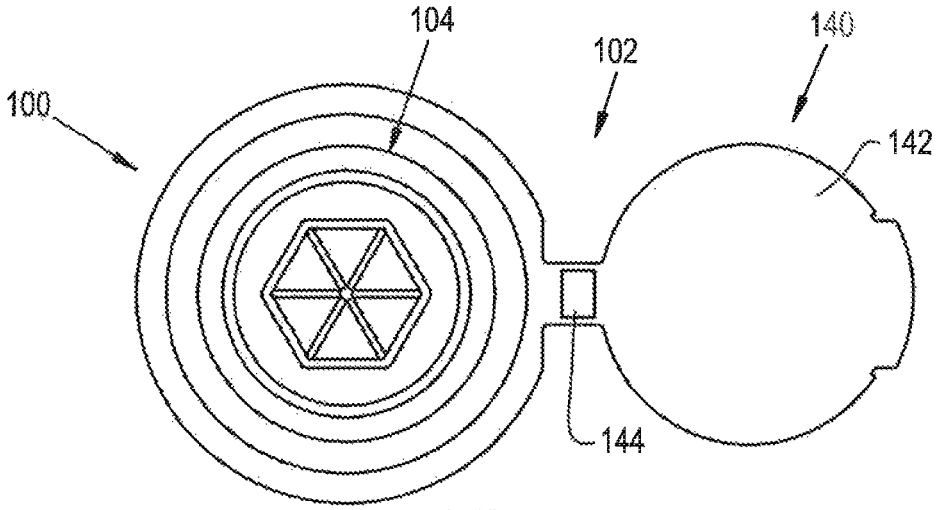
FIG. 2 is a plan view of the inside of the access structure.
Figure 3:
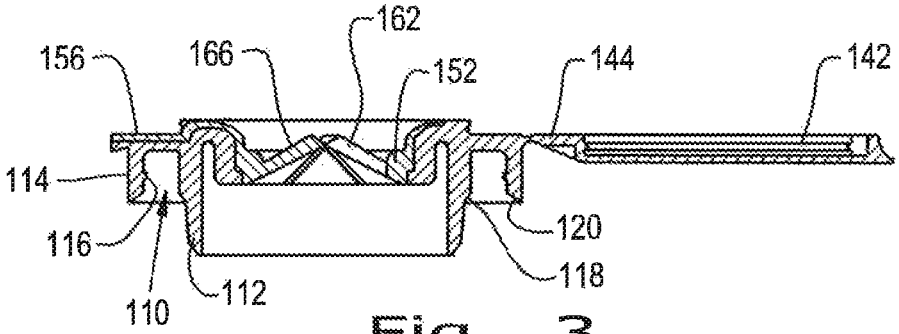
FIG. 3 is a cross-sectional view of the access structure shown in FIGS. 1 & 2, taken along line 3-3 of FIG. 1.
Figure 4:
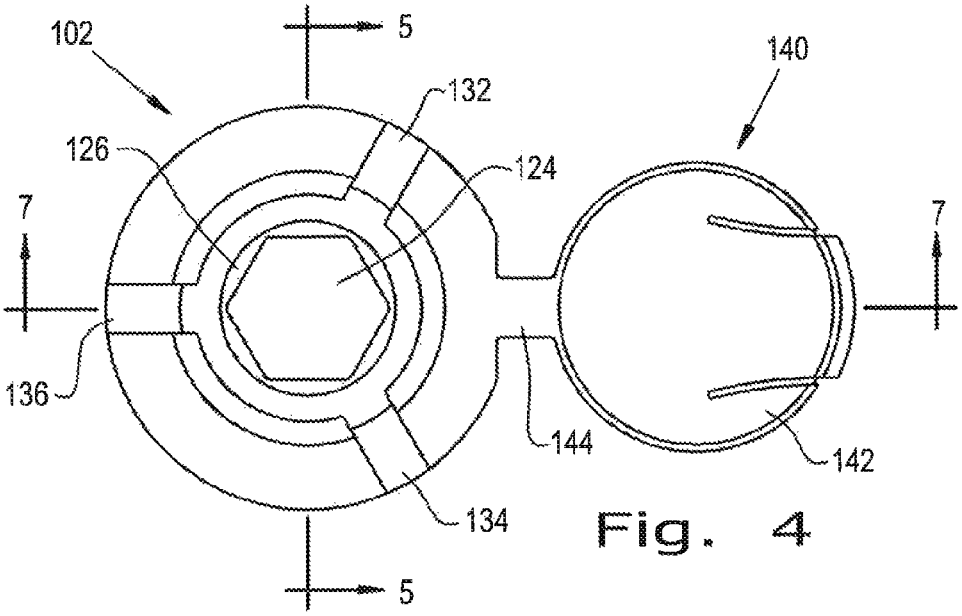
FIG. 4 is a plan view of the attachment body in the access structure.
Figure 5:
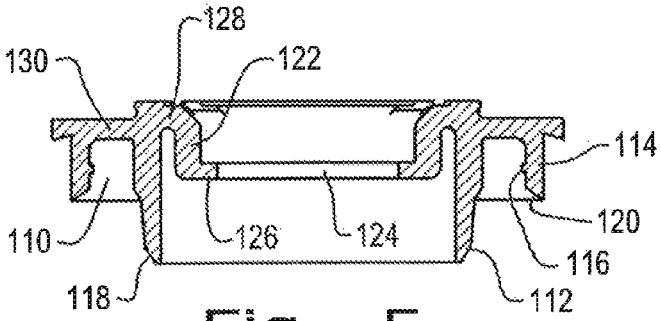
FIG. 5 is a cross-sectional view of the attachment body shown in FIG. 4, taken along line A-A of FIG. 4.
Figure 6:
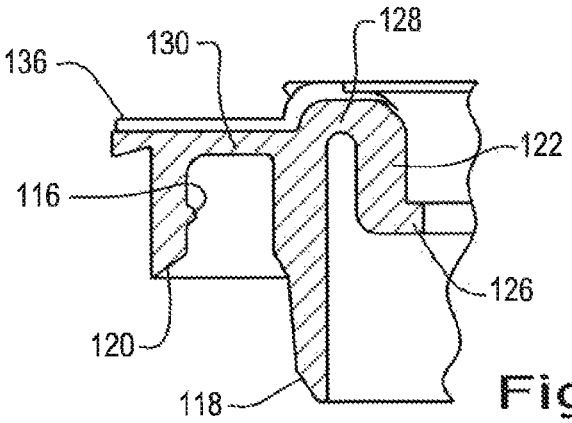
FIG. 6 is an enlarged, cross-sectional view of a portion of the cross-sectional view in FIG. 5.
Figure 7:
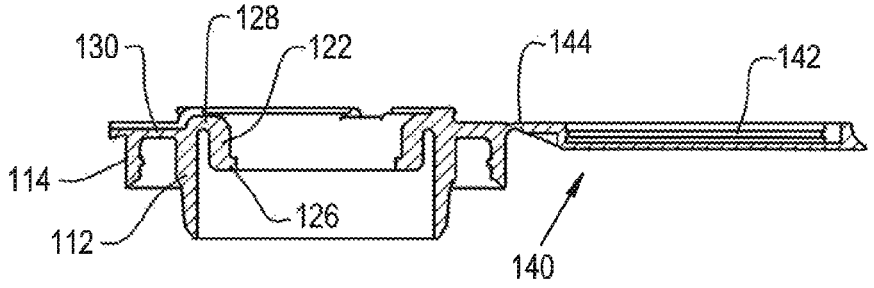
FIG. 7 is a cross-sectional view of the attachment body shown in FIG. 4, taken along line 7-7 of FIG. 4.
Figure 8:
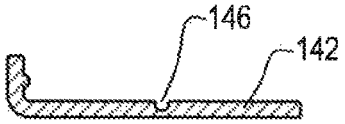
FIG. 8 is a cross-sectional view of a cover in the attachment body.
Figure 9:
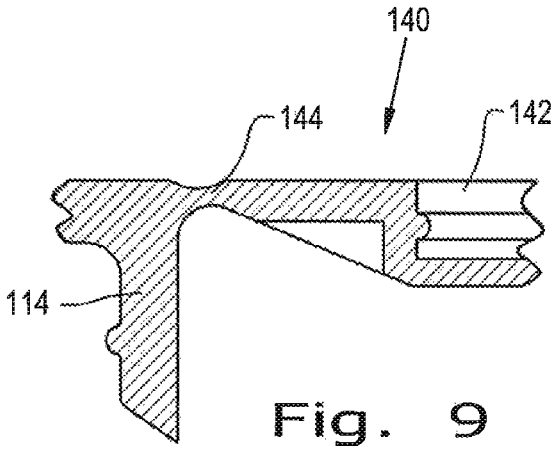
FIG. 9 is an enlarged view of a portion of the cross-sectional view shown in FIG. 7.
Figure 10:
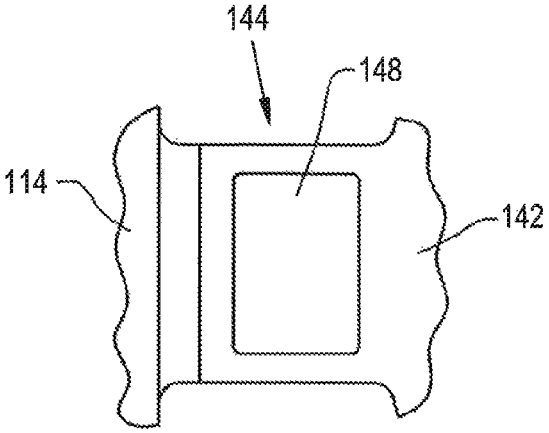
FIG. 10 is an enlarged plan view of a hinge between portions of the attachment body.
Figure 11:
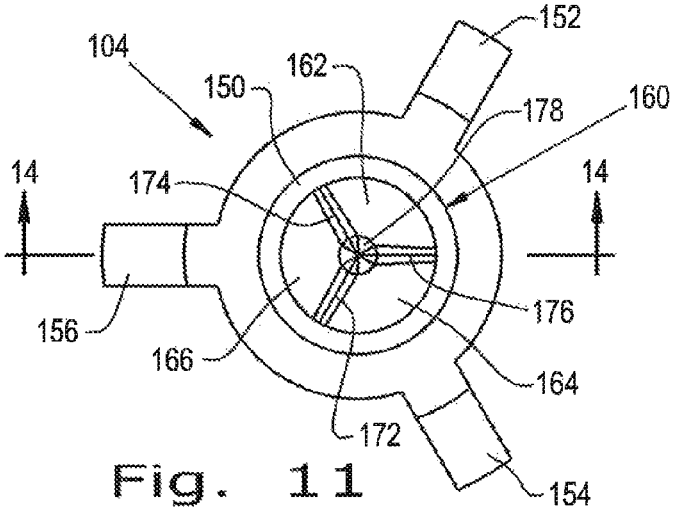
FIG. 11 is a plan view of the outside of the access valve for the access structure.
Figure 13:
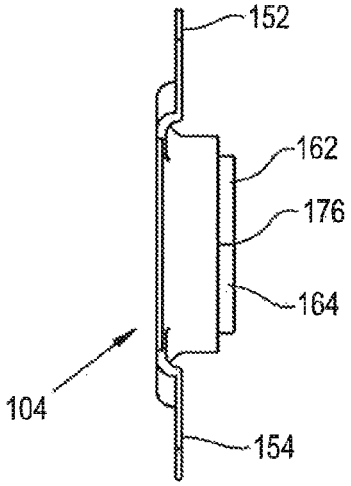
FIG. 13 is a side elevational view of the access valve of the access structure.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more particularly to the drawings, an access structure 100 for a bag in a box container is shown. Access structure 100 includes first and second components that are hermetically sealed prior to first use for dispensing material there through. Accordingly, access structure 100 includes an attachment body 102 and an access valve 104. Access structure 100 is made of moldable materials in a two shot molding process whereby attachment body 102 is first formed of one material, and access valve 104 of a second material is over molded onto the previously formed attachment body 102. By forming access structure 100 in a two shot molding process, no subsequent assembly is required, and, since the over molded materials are bonded one to the other in the molding process, a hermetic seal is provided by the single body construction even when two different materials are used for attachment body 102 and access valve 104.

Attachment body 102 is a monolithic body of injection molded plastic of suitable type for the application, including compatibility with the materials to be contained in and dispensed from the bag in which access structure 100 will be used. Attachment body 102 defines a generally annular cavity 110 between an inner wall 112 and an outer wall 114. Attachment body 102 can be attached to an opening in a bag container by any suitable means, such as by welding the bag into annular cavity 110, snap fit engagement of a boss formed in the bag container into annular cavity 110, etc. A protrusion 116 encircling annular cavity 110 or a plurality of discrete protrusions 116 can be used to facilitate the attachment of body 102 to a bag container. Further, inner wall 112 and/or outer wall 114 can be provided with chamfers 118, 120 also to facilitate installation of body 102 in a bag container.

Attachment body 102 further defines a well 122 inwardly of inner wall 112, for receiving access valve 104 in a subsequently performed overmolding process. Well 122 defines an aperture 124 centrally located in a floor 126 at the bottom of well 122.

A rim 128 between well 122 and inner wall 112, and a barrier 130 between inner wall 112 and outer wall 114 together define an outer surface of attachment body 102. A plurality of shallow channels 132, 134, 136 are provided in the outer surface formed by rim 128 and barrier 130, generally extending from well 122 to the outer perimeter of attachment body 102. In the exemplary embodiment, three shallow channels 132, 134, 136 are provided; but more channels or fewer channels can be used. During the overmolding of access valve 104 onto attachment body 102, channels 132, 134, 136 are filled with the material of access valve 102, to further anchor the access valve to the body.

Attachment body 102 further includes a tamper indicating enclosure 140, which includes a cover 142 connected to outer wall 114 by a hinge 144. Cover 142 is of a size and shape to overlie well 122 and access valve 114 provided therein. Cover 142 can be snapped into well 122 and secured therein to establish a physical protective barrier over access valve 104. Cover 142 can include a slot 146 to engage well 122 and/or to provide a less resilient area that can distort upon opening to indicate previous use or tampering, Hinge 144 may include a window 148 to facilitate bending and/or to provide another area of less resilience that can distort or even rupture upon opening to indicate previous use or tampering.

Access valve 104 is formed by overmolding into and over well including extending across aperture 124, on floor 126, over the outer surface of rim 128 and into channels 132, 134, 136. Access valve 104 may include a generally annular support ring 150 comprising a generally thicker area of material against and over floor 126 and into the transition between floor 126 and well 122. Access valve 104 extends generally over rim 128 and forms stabilizing and securing arms 152, 154, 156 filling channels 132, 134, 136. It should be understood that the general annular shape is exemplary, and other shapes also could be used. Whereas three stabilizing and securing aims 152, 154, 156 are shown, more arms or fewer aims also can be used with a corresponding number of the aforedescribed shallow channels 132, 134, 136.

The center of access valve 104 defines a rupturable receiver 160 that is exposed in aperture 124 and can be pierced by a probe, valve or other extraction structure that can be inserted for removing the content of a bag in which access structure 100 is used. Viewed from the outside thereof, receiver 160 is a convex cone generally defining three pie-shaped segments or pieces 162, 164, 166. As formed, a frangible link or web 172, 174, 176 is established between the adjacent edges of pie-shaped pieces 162, 164, 166, with the frangible links 172, 174, 176 joining in a frangible center 178 at the apexes of the pie-shaped pieces. It should be understood that access valve 104 is of monolithic construction, and the frangible links 172, 174, 176 and frangible center 178 are simply thinned material regions between the adjacent thicker portions defining the pie-shaped pieces 162, 164, 166.

Figure 12:
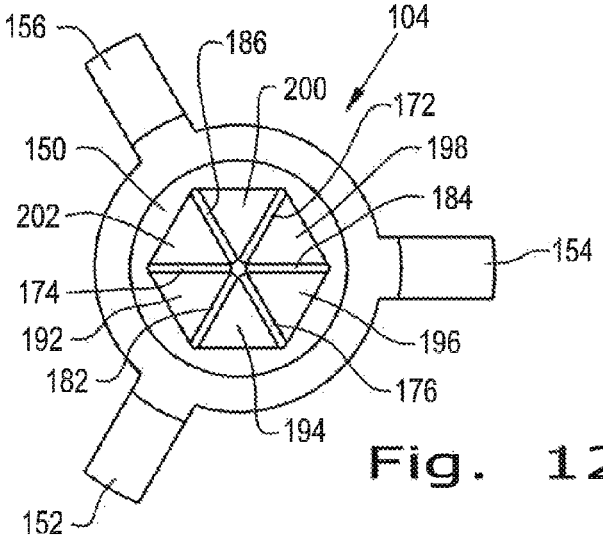
FIG. 12 is a plan view of the inside of the access valve for the access structure.
Figure 14:
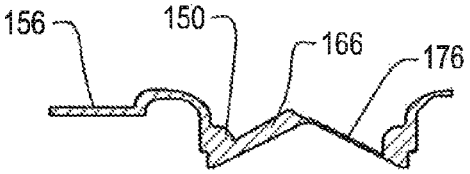
FIG. 14 is a cross-sectional view of the access valve of the access structure taken along line 14-14 in FIG. 11.

As seen most clearly in FIG. 12, the interior surface of rupturable receiver 160 is differently shaped than the outer surface thereof A depression or crease 182, 184, 186 is provided along the centerline of each pie-shaped piece 162, 164, 166, respectively, each crease 182, 184, 186 extending substantially from the apex to the base edge of the pie shaped piece 162, 164, 166 on which it is formed. The creases 182, 184, 186 are thinned material regions within each pie shaped piece 162, 164, 166, but, being formed only in the inner surface of receiver 160 are generally thicker than the frangible links 172, 174, 176 which extend inwardly from both the inner surface and outer surface of receiver 160. Accordingly, while the outer surface of receiver 160 defines three pie-shaped pieces 162, 164, 166, the inner surface defines six pie-shaped surfaces 192, 194, 196, 198, 200, 202 between the alternating frangible links 172, 174, 176 and creases 182, 184, 186.

During use, a probe or valve is inserted through receiver 160, thereby rupturing the frangible links or webs 172, 174, 176 between pie-shaped pieces 162, 164, 166 and frangible center 178 at the apexes thereof. Typically, the creases 182, 184, 186 are not ruptured during the installation of a probe or valve, but may be stretched. The separated pie shaped pieces 162, 164, 166 are urged against the probe or valve as a result of the convex shape of receiver 160. If the probe or valve is extracted from receiver 160, the thermoplastic material of the receiver does not necessarily flex back to its original shape before piercing. The resultant overstretching of the thermoplastic from the convex side helps to urge the individual pie shaped pieces against each other when the probe or valve is removed. The reduced thicknesses established along creases 178, 180, 182 allow for better conformation against a probe or valve inserted and change loading such that stretching can occur both to increase sealing against the inserted probe or valve and to urge the closing of pie shaped pieces 162, 164, 166 against one another even after the frangible links 172, 174, 176 have been ruptured.

Attachment body 102 and access valve 104 can be formed of different materials, the selection of which can be determined depending on the contents to be held in the bag for which access structure 100 is provided. For example, and not limitation, polypropylene can be used for attachment body 102 and a thermoplastic elastomer for access valve 104. For the purposes of further example, different thermoplastics can be used for acidic and non-acidic contents in the bag, for bags that will be ambient and those that will be refrigerated as well as for water-based and oil-based bag contents. Suitable materials for the different contents that may be held in a bag in box container are well known to those skilled in the art. Being formed in an overmolding process which bonds the materials together, attachment body 102 and access valve 104 create a hermetic seal before disruption of frangible links 172, 174, 176.

Tamper evidence is provided in several ways. First, the structures of cover 142 and/or hinge 144 can be provided with cored sections, undercuts and the like whereby deformation occurs upon initial opening. Cover 142 can be designed so as to be incapable of reattachment after being disengaged from a closed position over well 122 as a result of deformation of its structure, breakage of hinge 144, or the like. Further, frangible links or webs 172, 174, 176 provide a further visual indication that rupturing has occurred. Other types of tamper indicative connections can be used between cover 142 and attachment body 102 that are modified upon initial opening, so that if cover 142 is disengaged from its initial closed condition, it can not be re-engaged, thus clearly indicating that it has been opened. Further, hinge 144 can be frangible so that it will break if cover 142 is opened.

It should be understood that a suitable hermetic seal can be achieved in ways other than providing receiver 160 as an uninterrupted, but rupturable structure. For example, if frangible links or webs 172, 174, 176 are formed instead as slits or cuts completely through the material of receiver 160, a suitable hermetic seal can be achieved through the use of undercuts and other engagement features between cover 142 and well 122, either in a way that prevents reengagement after first opening or in a way that enables reengagement.

Figure 15:
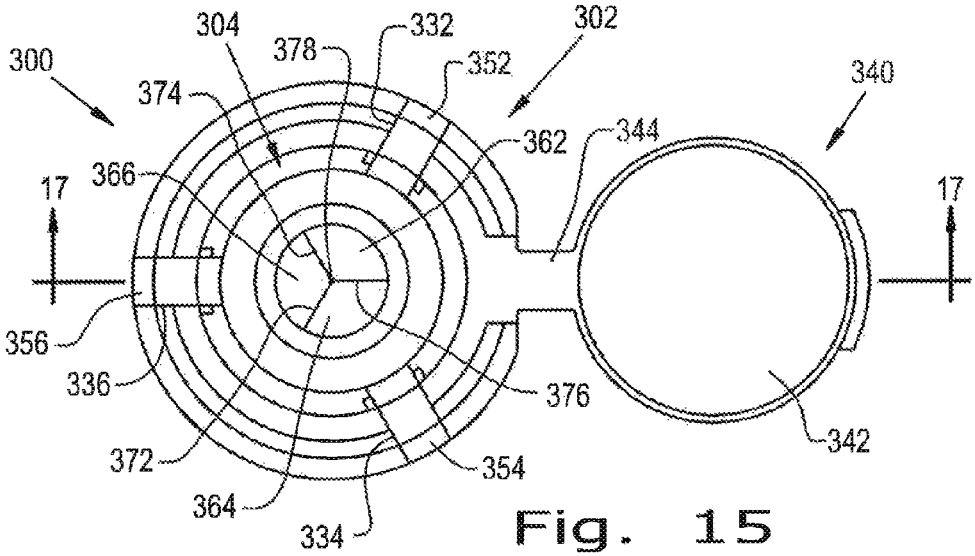
FIG. 15 is a plan view of the outside of another embodiment for an access structure for a bag in a box container.
Figure 16:
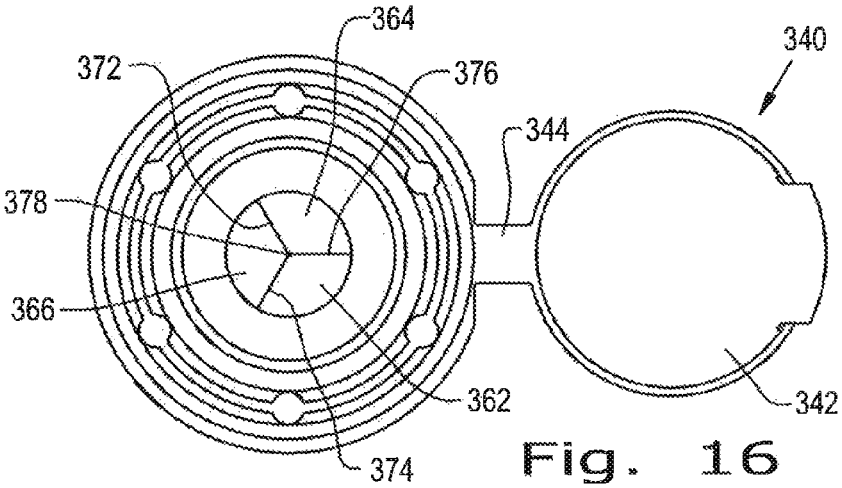
FIG. 16 is a plan view of the inside of the access structure shown in FIG. 15.
Figure 17:
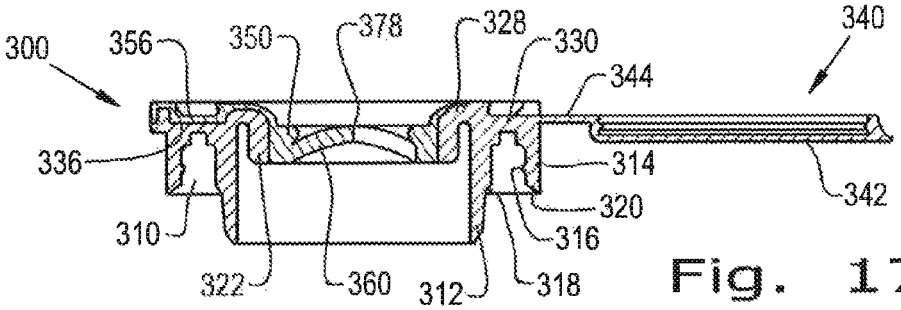
FIG. 17 is a cross-sectional view of the access structure shown in FIGS. 15 and 16, taken along line 17-17 of FIG. 15.

An overmolding process can be used to form one-piece access structures different from that described with respect above. FIGS. 15-17 illustrate an access structure 300 for a bag in a box container. Access structure 300 includes first and second components that are hermetically sealed prior to first use for dispensing material there through. Accordingly, access structure 300 includes an attachment body 302 and an access valve 304. Access structure 300 is made of moldable materials in a two shot molding process similar to that described previously herein whereby attachment body 302 is first formed of one material, and access valve 304 of a second material is over molded onto the previously formed attachment body 302. By forming access structure 300 in a two shot molding process, no subsequent assembly is required, and, since the over molded materials are bonded one to the other in the molding process, a hermetic seal is provided by the single body construction even when two different materials are used for attachment body 302 and access valve 304.

Attachment body 302 is a monolithic body of injection molded plastic of suitable type for the application, including compatibility with the materials to be contained in and dispensed from the bag in which access structure 300 will be used. Attachment body 302 is similar to attachment body 102 described previously herein and defines a generally annular cavity 310 between an inner wall 312 and an outer wall 314. Attachment body 302 can be attached to an opening in a bag container by any suitable means, such as by welding the bag into annular cavity 310, snap fit engagement of a boss formed in the bag container into annular cavity 310, etc. A protrusion 316 encircling annular cavity 310 or a plurality of discrete protrusions 316 can be used to facilitate the attachment of body 302 to a bag container. Further, inner wall 312 and/or outer wall 314 can be provided with chamfers 318, 320 also to facilitate installation of body 302 in a bag container.

Attachment body 302 further defines a well 322 inwardly of inner wall 312, for receiving access valve 304 in a subsequently performed overmolding process. Well 322 is a substantially annular ring having an open bottom, but may also be of other shapes and may have a partial floor with an aperture therein similar to aperture 124 and floor 126 described previously herein.

A rim 328 between well 322 and inner wall 312, and a barrier 330 between inner wall 312 and outer wall 314 together define an outer surface of attachment body 302. A plurality of shallow channels 332, 334, 336 similar to the previously described channels 132, 134, 136 are provided in the outer surface formed by rim 328 and barrier 330, generally extending from well 322 to the outer perimeter of attachment body 302. In the exemplary embodiment, three shallow channels 332, 334, 336 are provided; but more channels or fewer channels can be used. During the overmolding of access valve 304 onto attachment body 302, channels 332, 334, 336 are filled with the material of access valve 302, to further anchor the access valve to the body.

Attachment body 302 further includes a tamper indicating and hermetically sealing enclosure 340, which includes a cover 342 connected to outer wall 314 by a hinge 344. Cover 342 is of a size and shape to overlie well 322 and access valve 334 provided therein. Cover 342 can be snapped into well 322 and secured therein to establish a physical protective and hermetically sealing barrier over access valve 304. Cover 342 can include a slot (not shown) similar to slot 146 to engage well 322 and/or to provide a less resilient area that can distort upon opening to indicate previous use or tampering, Hinge 344 may include a window (not shown) similar to window 148 to facilitate bending and/or to provide another area of less resilience that can distort or even rupture upon opening to indicate previous use or tampering.

Access valve 304 is formed by overmolding into and over well 322, including extending across the open bottom of well 322, over the outer surface of rim 328 and into channels 332, 334, 336. Access valve 304 may include a generally annular support ring 350 comprising a generally thicker area of material against and within well 322. Access valve 304 extends generally over rim 328 and forms stabilizing and securing arms 352, 354, 356 filling channels 332, 334, 336. It should be understood that the general annular shape is exemplary, and other shapes also could be used. Whereas three stabilizing and securing arms 352, 354, 356 are shown, more arms or fewer arms also can be used with a corresponding number of the aforedescribed shallow channels 332, 334, 336.

The center of access valve 304 defines an outwardly rounded membrane like receiver 360 that is exposed in open bottom well 322 and can be pierced by a probe, valve or other extraction structure that can be inserted for removing the content of a bag in which access structure 300 is used. Viewed from the outside thereof, receiver 360 is a convex dome generally defining three generally pie-shaped segments or pieces 362, 364, 366. On the inside thereof, receiver 360 is smooth and concave and defines inner surfaces of the same three generally pie-shaped pieces or segments 362, 354, 366. As formed, a frangible link or web 372, 374, 376 is established between the adjacent edges of pie-shaped pieces 362, 364, 366, with the frangible links 372, 374, 376 joining in a frangible center 378 at the apexes of the pie-shaped pieces. It should be understood that access valve 304 is of monolithic construction, and the frangible links 372, 374, 376 and frangible center 378 are simply thinned material regions between the adjacent thicker portions defining the pie-shaped pieces 362, 364, 366. Alternatively, frangible links 372, 374, 376 can be pre-use slits formed completely through receiver 360 during manufacture, in which case hermetic sealing is provided by cover 342 on well 322 through suitable interference engagement, or by other hermetic sealing means. However, the interfaces between the different materials of attachment body 302 and access valve 304 are hermetically sealed through the overmolding process.

Techniques other than overmolding can be used to establish hermetic seals along the interfaces of different materials used for attachment bodies and access valves of access structures in accordance herewith. For example, in some applications and uses it may be desirable to use an expense material or a slow curing material as the access valve material. Material costs may make it desirable to minimize the amount of material used, and cycle time for an overmolding process can impact tool costs to meet desired production levels.

Figure 18:
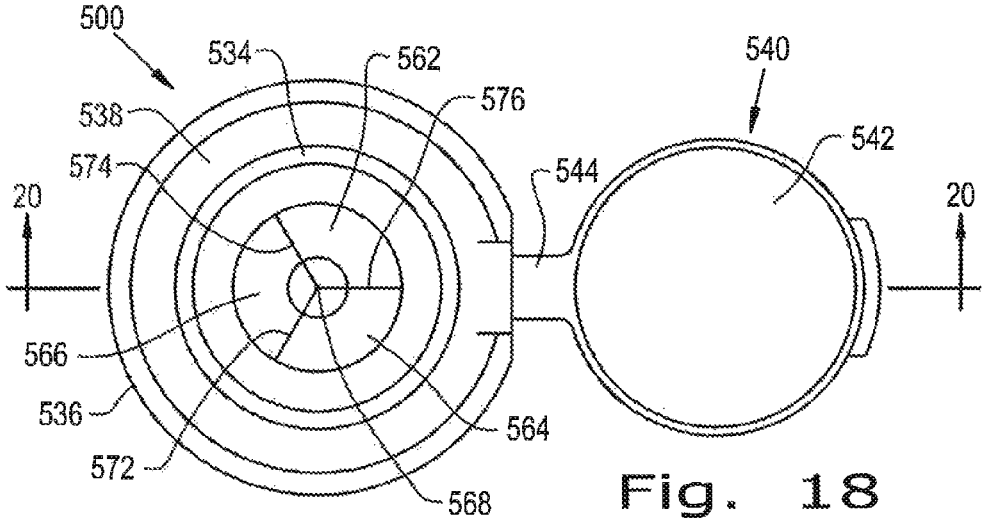
Figure 19:
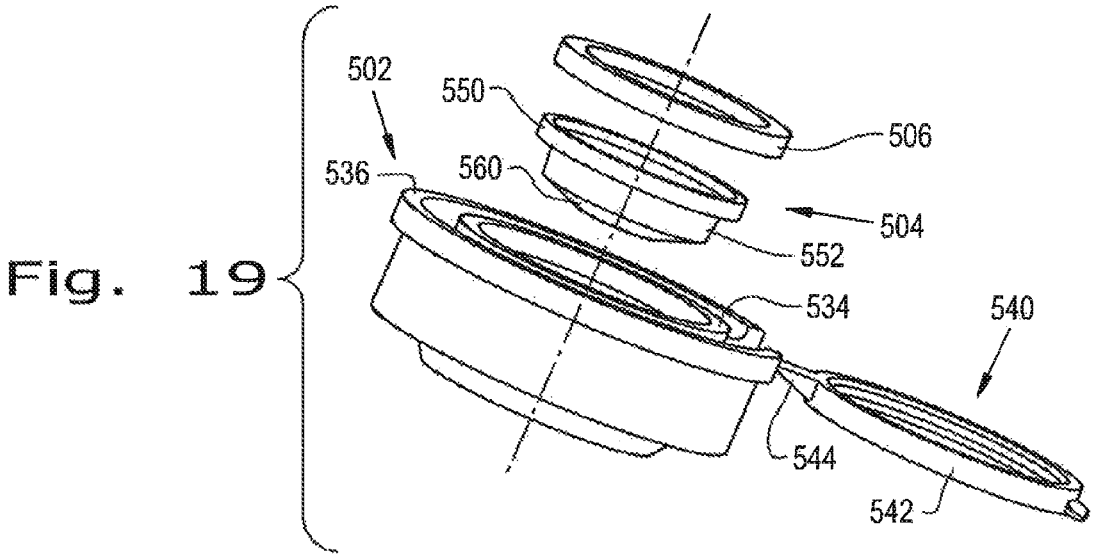
FIG. 19 is an exploded view of the access structure shown in FIG. 18.
Figure 20:
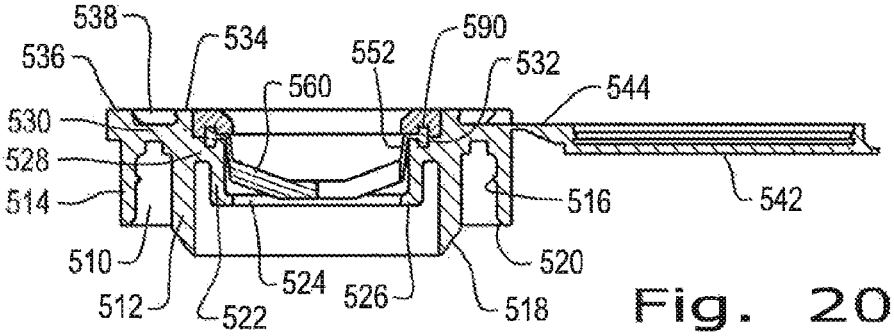
FIG. 20 is a cross-sectional view of the access structure shown in FIGS. 18 and 19, taken along line 20-20 of FIG. 18.
Figure 21:
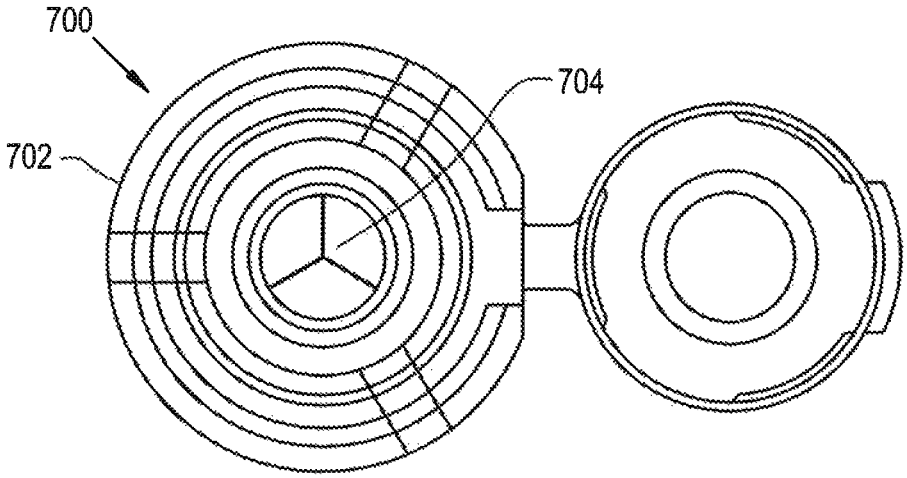
FIG. 21 is a plan view of another access structure.
Figure 22:
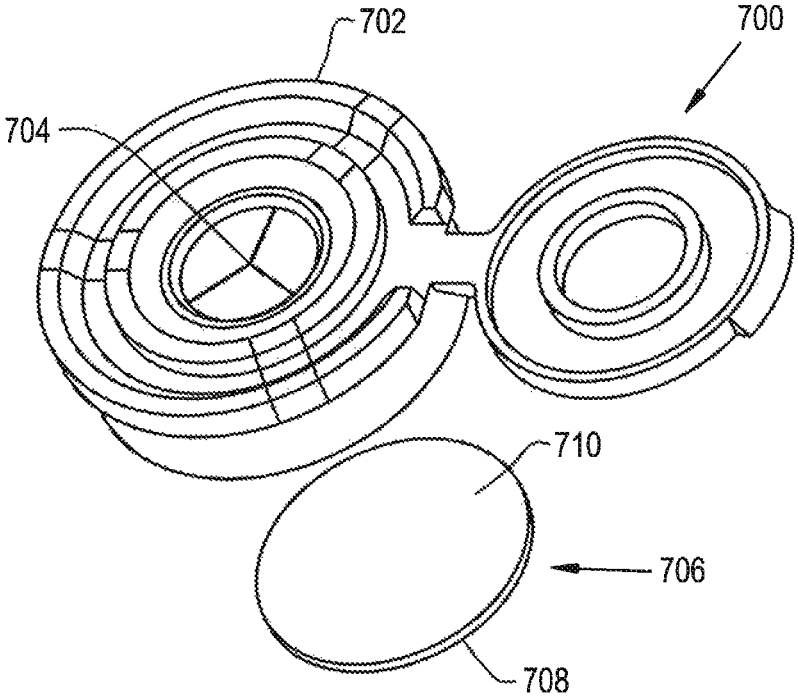
FIG. 22 is an exploded perspective view of the access structure shown in FIG. 21.
Figure 23:
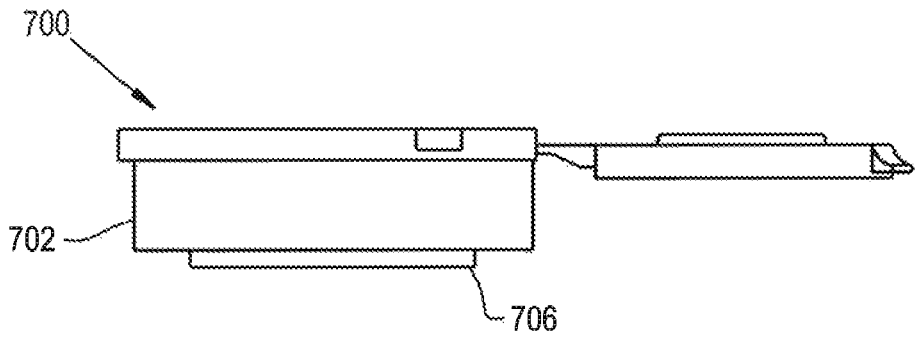
FIG. 23 is an elevational view of the access structure shown in FIGS. 21 & 22.
Figure 24:
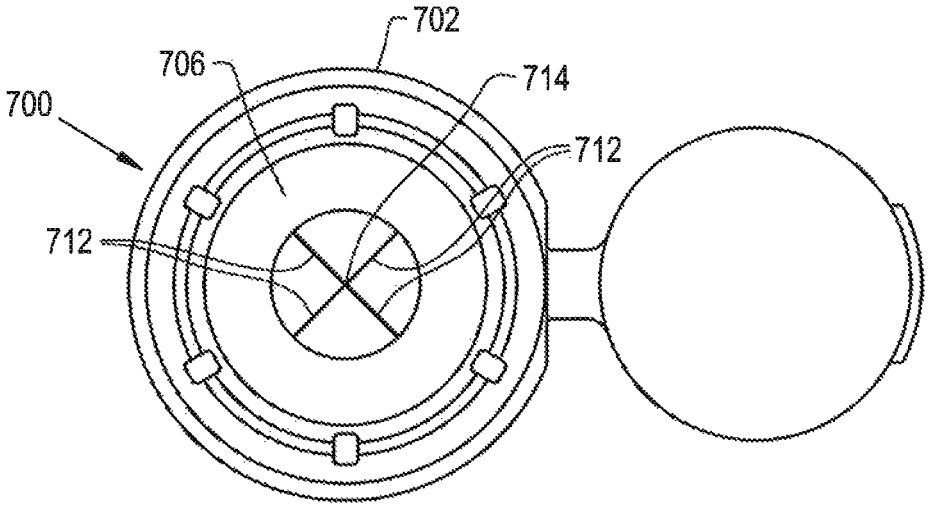
FIG. 24 is a plan view of the access structure shown in FIGS. 21-23, but illustrating the side opposite the side shown in FIG. 21.

FIGS. 18-20 illustrate an access structure 500 for a bag in a box container. Access structure 500 includes components that are hermetically sealed prior to first use for dispensing material there through. Accordingly, access structure 500 includes an attachment body 502 and an access valve 504 held together with a retainer ring 506. Access structure 500 is made of moldable materials that are assembled and joined with one another to establish hermetically sealed interfaces between the materials. Joining can be performed, for example, by ultrasonic welding. By joining the individual components forming access structure 500 in a process such as sonic welding, no subsequent assembly is required, and a hermetic seal is provided by the single body construction even when two different materials are used for attachment body 502 and access valve 504.

Attachment body 502 is a monolithic body of injection molded plastic of suitable type for the application, including compatibility with the materials to be contained in and dispensed from the bag in which access structure 500 will be used. Attachment body 502 is similar to attachment bodies 102 and 302 described previously herein and defines a generally annular cavity 510 between an inner wall 512 and an outer wall 514. Attachment body 502 can be attached to an opening in a bag container by any suitable means, such as by welding the bag into annular cavity 510, snap fit engagement of a boss formed in the bag container into annular cavity 510, etc. A protrusion 516 encircling annular cavity 510 or a plurality of discrete protrusions 516 can be used to facilitate the attachment of body 502 to a bag container. Further, inner wall 512 and/or outer wall 514 can be provided with chamfers 518, 520 also to facilitate installation of body 502 in a bag container.

Attachment body 502 further defines a well 522 inwardly of inner wall 512, for receiving access valve 504. Well 522 defines an aperture 524 centrally located in a floor 526 at the bottom of well 522, all similar to well 122, aperture 124 and floor 126 described previously. Alternatively, well 522 can be a substantially annular ring having an open bottom, as described for well 322 previously.

A rim 528 between well 522 and inner wall 512, and a barrier 530 between inner wall 512 and outer wall 514 together define an outer surface of attachment body 502. Rim 528 is a ledge-like structure which receives both an outer periphery of access valve 504 and retainer ring 506 as will be described subsequently herein. Rim 528 defines an annular channel 532 in the upper surface thereof. Channel 532 is spaced inwardly from an axially projecting annular inner flange 534. An axially projecting annular outer flange 536 is spaced from inner flange 534 to define an annular slot 538 between inner flange 534 and outer flange 536.

Attachment body 502 further includes a tamper indicating and hermetically sealing enclosure 540, which includes a cover 542 connected to outer wall 514 by a hinge 544. Cover 542 is of a size and shape to overlie well 522 and access valve 554 provided therein. Cover 542 can be snapped into annular slot 538 and secured therein to establish a physical protective and hermetically sealing barrier over access valve 504. Cover 542 can include a less resilient area that can distort upon opening to indicate previous use or tampering, Hinge 544 may include a window (not shown) similar to window 148 to facilitate bending and/or to provide another area of less resilience that can distort or even rupture upon opening to indicate previous use or tampering.

Access valve 504 is a cup-like structure formed by molding independently of attachment body 502. Access valve 504 may include a generally annular support ring 550 comprising a generally thicker area of material, an inner portion of which is received in channel 532. Access valve 504 extends inwardly from channel 532, over the inner edge of rim 528 and into well 522. Within well 522, access valve 504 spans aperture 524 and floor 526.

The center of access valve 504 defines an inwardly rounded membrane-like receiver 560 that is exposed in aperture 524 of well 522 and can be pierced by a probe, valve or other extraction structure that can be inserted for removing the content of a bag in which access structure 500 is used. Viewed from the outside thereof, receiver 560 is a concave dome generally defining three generally pie-shaped segments or pieces 562, 564, 566. On the inside thereof, receiver 560 is smooth and convex and defines inner surfaces of the same three generally pie-shaped pieces or segments 562, 554, 566. As formed, a frangible link or web 572, 574, 576 is established between the adjacent edges of pie-shaped pieces 562, 564, 566, with the frangible links 572, 574, 576 joining in a frangible center 578 at the apexes of the pie-shaped pieces. It should be understood that access valve 504 is of monolithic construction, and the frangible links 572, 574, 576 and frangible center 578 are simply thinned material regions between the adjacent thicker portions defining the pie-shaped pieces 562, 564, 566. Alternatively, frangible links 572, 574, 576 can be pre-use slits formed completely through receiver 560 during manufacture, in which case hermetic scaling is provided by cover 542 on well 522 through suitable interference engagement, or by other hermetic sealing means. However, the interfaces between the different materials of attachment body 502 and access valve 504 are hermetically sealed through the overmolding process.

Retainer ring 506 can be of the same material as attachment body 502, or can be of different material, and is formed by molding independently of attachment body 502 and access valve 504. Retainer ring 506 fits against and within the L-shaped ledge generally formed by rim 528 and inner flange 534. On the as-installed bottom thereof, retainer ring 506 defines a channel 590 to receiver an outer portion of support ring 550.

During manufacture of access structure 500, attachment body 502, access valve 504 and retainer ring 506 are separately and independently provided. Access valve 504 is assembled into attachment body 502, with support ring 550 of access valve 504 received snuggly within both channel 532 in rim 528 and channel 590 in retainer ring 506, with a portion of access valve 504 immediately inward from support ring 550 being sandwiched between retainer ring 506 and rim 528 immediately inwardly radially from channels 532 and 590. Surfaces of radially outer portions of retainer ring 506 are engaged against rim 528 outwardly of channel 532 and against an inward surface of inner flange 534. Through the use of known techniques such as ultrasonic welding the engaged surfaces between the components are permanently joined one to another to establish a one-piece structure.

The pie-shaped pieces of the various embodiments disclosed herein seal sufficiently around probes and other equipment inserted for the extraction of contents, and close sufficiently to inhibit undesirable leakage if the probe or equipment is removed. When such probe or equipment is removed, the pie-shaped pieces close sufficiently even if one or more of the pie-shaped pieces begins to rebound before the others, or if one or more rebounds more quickly than others result in a mis-aligned but overlapping arrangement of the pie-shaped pieces.

A hermetic seal can be provided in yet other ways. For example, a rupturable inner barrier can be provided in addition to any of the aforedescribed access valve structures. When used with an additional hermetic inner seal harrier, the frangible links of the access structures can be provided as frangible links, or can be completely cut through, relying on the additional inner barrier for a hermetic seal. However, the access valve structures as previously described either with frangible links or completely cut through along the lines of the frangible links provide both physical support and protection for the hermetic inner seal barrier, and provide closure when the container is removed from dispensing equipment in which it is installed.

In an embodiment of a hermetic seal inner barrier, the hermetic seal inner barrier is provided as a foil layer, such as, for example, aluminum foil, and a support or fixing layer such as, for example, polypropylene. The foil layer and support layer can be laminated to one another, or otherwise physically bonded or attached. A disc comprising the laminated structure of a poly propylene layer and an aluminum foil layer can be attached to the valve structure by induction welding or other suitable fastening technique. To facilitate insertion of a probe or dispensing equipment, which may be blunt and which may not be centered in the hermetic seal when first being installed, the inner barrier layer is provided with stress risers to direct and localize tearing of the barrier when a probe or dispenser is inserted. Without the use of such stress risers, the foil can tear randomly, perhaps with a fragment totally separated which can then enter into the dispensing equipment and/or the fluid contained in the container in which the access structure is used. The stress risers can be provided as a pattern of impressions having a dimensional relationship to a probe or dispensing equipment to be inserted there through. Multiple impressions radiating out from a center point can be used, with each of the impressions having a length corresponding to the radius of a probe or equipment to be inserted therein. When the probe is inserted, the foil will tear along the lines of and as directed by the stress risers for a length sufficiently to allow insertion of the probe, and the foil will otherwise remain intact, thereby opening but not tearing into discreet separated pieces which could become intermixed with a fluid dispensed from a container in which the valve is used.

Referring now more specifically to FIGS. 21-25, an access structure 700 is shown, which includes an attachment body 702 and an access valve 704. Attachment body 702 and access valve 704 can be similar to any of the attachment bodies and access valves described previously herein. Additionally, access structure 700 includes an hermetic barrier seal 706 which may be a laminated structure having a foil layer 708 and a carrying layer 710 of polypropylene or other known heat sealing material. Alternatively, carrying layer 710 can be a layer of adhesive for attaching barrier seal 706. Barrier seal 706 is attached to the container facing side of access structure 700 and maybe secured thereto by induction welding, ultrasonic conduction, lamination, simple adhesion or heat activated adhesion when the carrying layer 710 is an adhesive layer 710, or the like. A configuration of a stress riser 712 radiating from a stress point 714 is formed into barrier 706. In the exemplary embodiment shown, four right angle line segments are formed in the stress riser configuration; however, it should be understood that other patterns can be used. The individual segments of the stress riser configuration do not rupture the barrier until pressure from a probe or dispensing equipment is applied against the barrier when the probe or dispensing equipment is inserted through the access structure. The lengths of the individual lines of the stress riser configuration define a pattern having a diameter corresponding to the diameter of a probe or dispensing equipment to be inserted. The stress riser configuration also can be of a diameter greater than the diameter of a probe or other dispensing equipment to be used.

Figure 25:
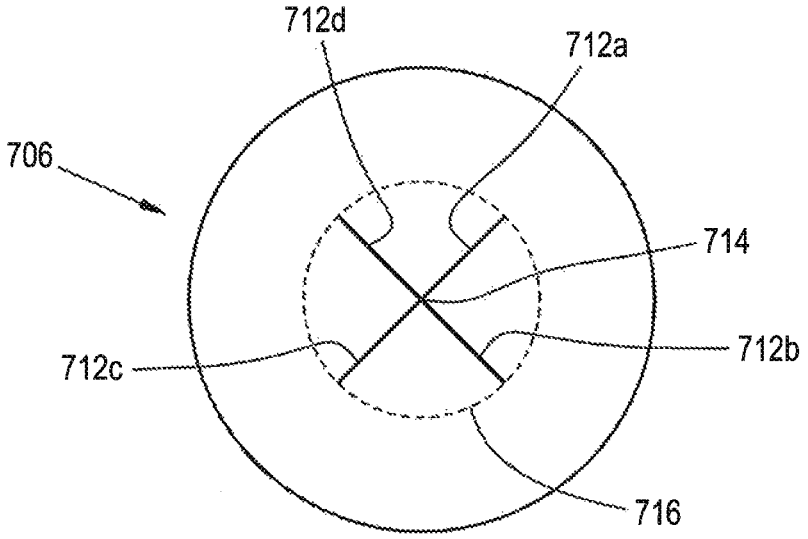
FIG. 25 is a plan view of a part of the access structure shown in FIGS. 21-24.

Barrier seal 706 is shown in FIG. 25 with individual stress riser segments 712*a*, 712*b*, 712*c* and 712*d* extending outwardly from stress point 714. Adjacent pairs of stress riser segments 712*a*-712*d* are at right angles and have a length of about a radius dimension of a probe or dispensing equipment to be inserted there through. Accordingly, the radially outer ends of the stress riser segments 712*a*-712*d* define a circle 716 to accommodate the probe or dispensing equipment to be inserted there through.

Figure 26:
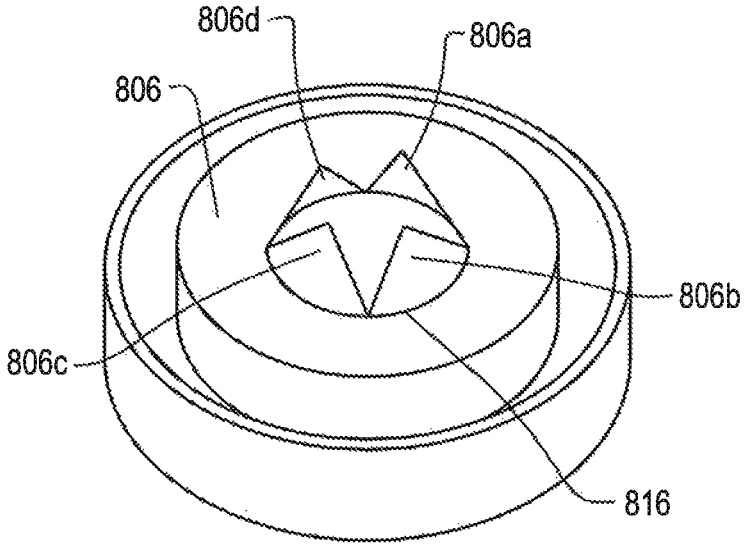
FIG. 26 is a perspective view of a part of the access structure shown in FIGS. 21-24, illustrating its condition after use.
Figure 27:
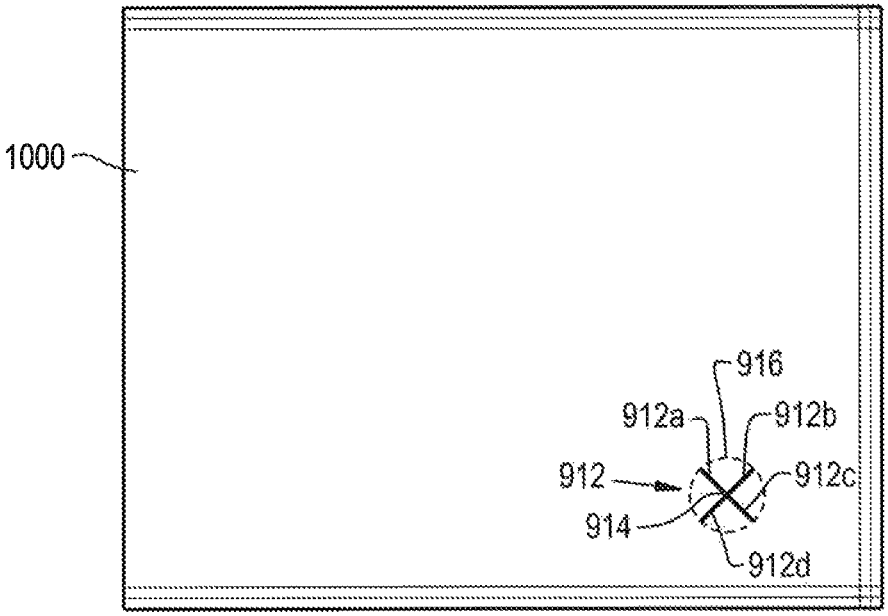
FIG. 27 is a view of a another type of container for which an access valve as disclosed herein can be used.
Figure 28:
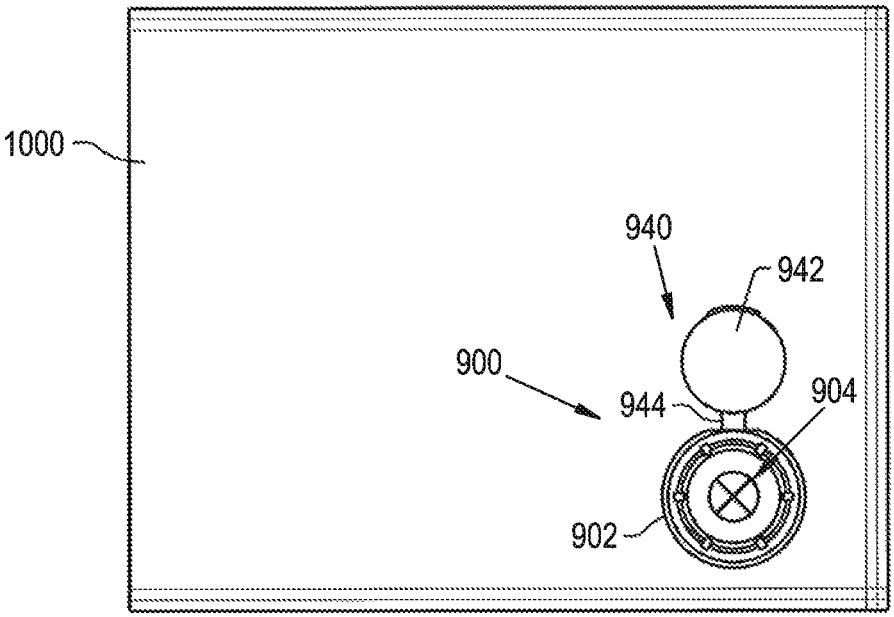
FIG. 28 is a view of the container shown in FIG. 27, in a condition of preparation to be emptied.
Figure 29:
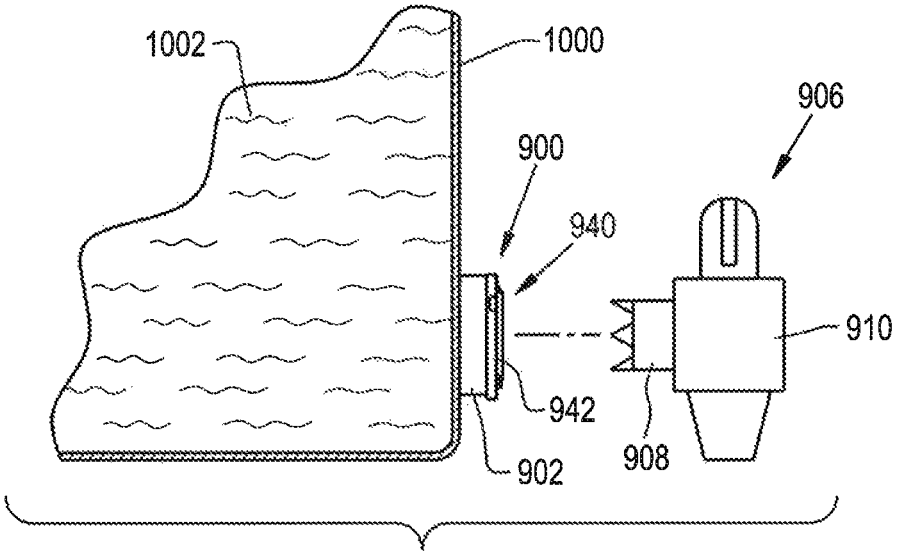
FIG. 29 is a view of the container shown in FIGS. 27 & 28 prior to that depicted in FIGS. 28.
Figure 30:
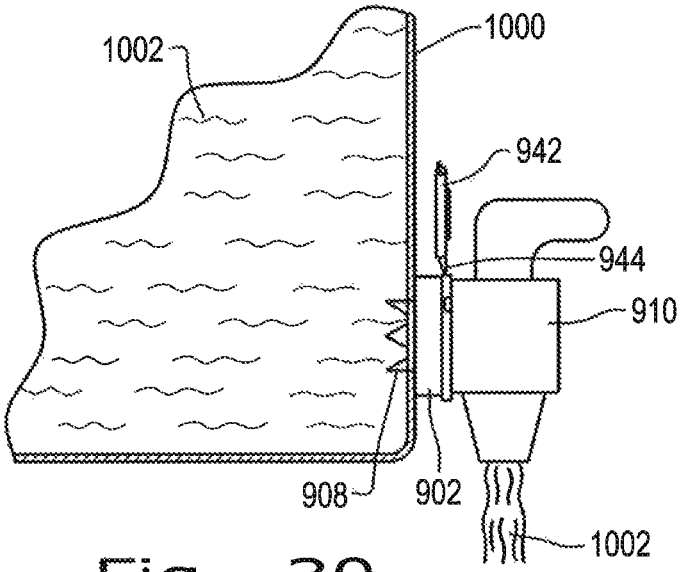
FIG. 30 is a cross-sectional view of the container shown in FIGS. 27-29 showing the structure while the contents is being emptied therefrom.

When provided in the manner described above, the stress riser configuration 712 will direct tearing of the foil barrier seal 706 when the probe or dispensing equipment is inserted, and the foil barrier seal tears cleanly, without separated portions or fragments. The stress riser configuration facilitates clean tearing of the foil even when a substantially blunt probe is inserted and/or the probe is inserted far off center of the barrier. FIG. 26 illustrates a ruptured barrier seal 806 which is similar to barrier seal 706, but illustrates the condition of a barrier seal after use. Ruptured barrier seal 806 defines generally triangular shaped seal segments 806*a*, 806*b*, 806*c* and 806*d* which are separate from one another while remaining connected adjacent each other generally along a circle 816 defined at the bases of the seal segments 806*a*-806*b*.

An access structure as described herein also can be used on other bag-like containers, such as those sometimes referred to as "slash and dump" bags intended for a single use. It is known to use poly films on vertical fill bag formers. Horizontal processes for filling and forming the bags are known also. In known processes, roll stock of polypropylene film, or other film or film laminate, is provided as a sleeve or pouch, sealed at one end, filled and sealed at the opposite end to form a pillow, pouch or bag with a content sealed therein. These types of containers may be used when the content is generally spilled rapidly in a less controlled manner. However, sometimes it is desired to empty the contents under more control and direction, or to interrupt or temporarily suspend emptying the bag when less than the total content of the bag has been dispensed. Access structures as disclosed herein can be used to provide a more controlled, interruptible empty procedure for such bag-like containers.

Referring now more specifically to FIGS. 27-30, an access structure 900 is shown for a pillow, pouch or bag 1000. Pillow, pouch or bag 1000 contains a flowable material content 1002 that may otherwise be contained in a bag roughly ruptured to spill the contents there from. By employing the use of access structure 900 on bag 1000, contents 1002 can be emptied from bag 1000 in a more controlled process, and emptying can be interrupted or suspended with the access structure subsequently closed to protect the contents from contamination or accidental, unintended spilling.

Access structure 900 includes an attachment body 902 and an access valve 904. Attachment body 902 and access valve 904 can be similar to any of the attachment bodies and access valves described previously herein. When emptying bag 1000, access structure 900 can be used with emptying device 906 having a rupturing probe 908 and a shut off 910.

Attachment body 902 is attached directly to bag 1000 over and surrounding a stress riser configuration 912. Stress riser configuration 912 is similar to stress riser configuration 712 and radiates from a stress point 914. Stress riser configuration 912 and stress point 914 are formed directly in the material of bag 1000. In the exemplary embodiment shown, four right angle line stress riser segments 912*a*, 912*b*, 912*c*, 912*d* are formed in the stress riser configuration; however, it should be understood that other patterns can be used for stress riser configuration 912. The individual segments of stress riser configuration 912 and stress point 914 are not so deep formed as to rupture bag 1000 until strong, direct pressure from a probe or dispensing equipment is applied against the stress riser configuration. The lengths of the individual lines of the stress riser configuration 912 define a pattern having a diameter corresponding to the diameter of probe 908, but also can be of a pattern defining a diameter greater than the diameter of probe 908 or even less than the diameter of probe 908. Advantageously, all of stress riser configuration 912 is surrounded by and covered by attachment body 902 to contain accidental or unintended spillage if the stress riser configuration is inadvertently ruptured prematurely, or in situations when emptying is suspended and the probe potentially removed.

Stress riser configuration 912 can be formed in a so-called "kiss cut" process wherein the surface of bag 1000 is shallow cut or etched or otherwise stressed. Various known processes can be used to create stress riser configuration 912, such as, for example, by ultrasonic processes. Stress riser configuration 912 creates an area of localized weakness in bag 1000, making the bag easier to pierce in that location. However, bag 1000 otherwise remains intact and hermetically sealed and is not prone to premature, easy, and unintended opening. Typically, stress riser configuration 912 is created before the bag is filled and sealed. However, a process can be used to create stress riser configuration 912 after filling bag 1000.

In the use of access structure 900 attachment body 902 is attached to bag 1000 after the formation of stress riser configuration 912, and may be attached either before or after filling bag 1000. Attachment body 902 may be attached to the outer surface of bag 1000 with glue or other adhesive, by heat sealing procedures, by material welding or by any other adequate attachment process.

To provide tamper resistance and/or evidence or indication if tampering or unintended breach has occurred, attachment body 902 is provided with a tamper indicating enclosure 940 having a cover 942 connected by a hinge 944 similar to those described previously herein for other embodiments. Cover 942 can be snapped onto attachment body 902 to establish a physical protective barrier over access valve 904. Hinge 944 may include apertures or openings to facilitate bending and/or to provide an area of less resilience that can distort or even rupture when opening occurs, to indicate previous use or tampering. The structures of cover 942 and/or hinge 944 can be provided with cored sections, undercuts and the like whereby deformation occurs upon opening. Cover 942 can be designed so as to be incapable of reattachment after being disengaged from a closed position against body 902, such as by deformation of its structure, breakage of hinge 944 or the like. Tamper indicating features of valve 904 also can be provided similar to those described previously with respect to other embodiments herein. Other types of tamper indicating connections can be used between cover 942 and attachment body 902 that are modified upon initial opening, so that if cover 942 is disengaged from its initial closed condition it cannot be reengaged, thus clearly indicating that it has been opened. Further, hinge 944 can be frangible so that it will break if cover 942 is opened.

When access structure 900 is to be used for opening bag 1000 so that content 1002 can be poured from bag 1000, emptying device 906 is used to rupture bag 1000 at the area of stress riser configuration 912. Emptying device 906 as shown is merely exemplary. It should be understood that other devices or implements also can be used. For example, it is anticipated that access structure 900 can be used with attachment body 902 only, and without access valve 904 provided therein. In such structures, a simple pipe, tube or even solid probe can be used and inserted through attachment body 902 to exert force against stress riser configuration 912 and thereby rupture the individual stress riser segments 912*a*, 912*b*, 912*c*, 912*d* so that content 1002 can be poured directly out of attachment body 902. If a solid probe is used, after rupturing stress riser configuration 912 the probe can be removed to allow the free flow of material through attachment body 902. If a pipe or tube is used as a probe, the pipe or tube can remain in place as a conduit tier directing flow from bag 1000. The pipe or tube can be connected to attachment body 902 by threaded engagement, tab and lock, or even simple interference fit of the tube against inner walls of attachment body 902.

Advantages can be obtained from using an emptying device having a closable means, such as emptying device 906 having shut off 910. Cover 942 is moved to an open position, thereby indicating that stress riser configuration 912 has been exposed for a first time to potential access thereof. Rupturing probe 908 is inserted through attachment body 902 to exert force against stress riser configuration 912, thereby causing individual stress riser segments 912*a*, 912*b*, 912*c*, and 912*d* to rupture, allowing probe 908 to enter bag 100. Tearing along the individual stress riser segments generally defines an opening generally defined by a circle indicated by a dotted line in FIG. 27 and designated with the reference 916. The physical attachment of attachment body 902 against the surface of bag 1000 further inhibits unintended tearing or rupturing beyond the connection of attachment body 902 to the surface of bag 1000. Emptying device 906 can be solidly attached to attachment body 902 by threaded connection, tab and lock connection, interference fit or other suitable association. Emptying device 906 can be inserted and attached with shut off 910 in a closed position, and the assembly subsequently positioned for emptying as desired. Shut off 910 can be used to commence emptying and then terminate or interrupt emptying before the entire content has been removed from bag 1000. Emptying can be resumed at a later time either in the same or a different location. In this way, a single bag 1000 can be partially emptied at several locations, or at a single location at different times.

In some uses for access structure 900, it may be advantageous to form attachment body 902 and a suitable rupturing probe as a single molding, with a tether or frangible link allowing molding of the probe away from the body but connected thereto in a way so that the probe can be inserted into the body for use. In yet other uses for access structure 900, it may be advantageous to form attachment body 902 and a suitable emptying device as an assembly attached to the bag, with the emptying device having a probe that can be advanced from a retracted position to an inserted position with the emptying device already assembled to the attachment body. In this way, all components are prior assembled to the bag, and opening requires only adjustment of the emptying device to rupture the bag and pour the content there from.

Further variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An access structure for a bag; comprising:

a first component made of a first material as a monolithic body adapted and arranged for attachment to the bag;

a second component made of a second material overmolded on said monolithic body and forming an access valve suitable for receiving dispensing equipment there through;

an area of localized weakness provided in the bag prior to opening the bag, said area of localized weakness having a stress riser configuration therein to direct tearing of the bag and access to the bag;

said first component attached to the bag in a position overlying said area of localized weakness; and an emptying device selectively positioned with respect to said first component and said area of localized weakness including a first position away from said area of localized weakness and a second position extending into said bag through said area of localized weakness.

2. The access structure of claim 1, said area of localized weakness including stress riser segments radiating outwardly from a stress point.

3. The access structure of claim 1, said stress riser configuration including a stress point and four stress riser segments radiating outwardly from said stress point.

4. The access structure of claim 3, said emptying device including a shut off.

5. The access structure of claim 1, said emptying device including a shut off.

6. The access structure of claim 1, including a tamper indicating enclosure overlying said second component prior to movement of said emptying device from said first position to said second position.

7. The access structure of claim 6, said stress riser configuration including a stress point and stress riser segments radiating from said stress point.

8. An access structure for a bag; comprising:

an area of localized weakness provided in said bag prior to opening the bag to dispense content therefrom, said area of localized weakness including a stress riser configuration formed in the bag for directed opening of said bag under a predetermined force applied against said area of localized weakness;

an attachment body attached to said bag and overlying said area of localized weakness;

a probe selectively positioned with respect to said attachment body and said area of localized weakness, including a first position of said probe away from said area of localized weakness and a second position of said probe extending into said bag through said area of localized weakness.

9. The access structure of claim 8, said stress riser configuration including a stress point and stress riser segments radiating outwardly from said stress point.

10. The access structure of claim 9, said stress riser configuration including at least three stress riser segments.

11. The access structure of claim 10, including a tamper indicating enclosure on said attachment body.

12. The access structure of claim 11, said tamper indicating enclosure including a tamper indicating cover and a hinge.

13. The access structure of claim 8, including a shut off associated with said probe and controlling flow from said bag through said attachment body and said probe.

14. An access structure for emptying content from a bag; said access structure comprising:

a stress riser configuration provided in said bag prior to opening said bag;

an attachment body connected to said bag and overlying said stress riser configuration; and a probe having a first position withdrawn from said bag and a second position with said probe inserted through said attachment body and against said stress riser configuration when rupturing said stress riser configuration to gain access to material contained in said bag.

15. The access structure of claim 14, further including a tamper indicating enclosure connected to said attachment body and overlying said stress riser configuration prior to said probe having moved from said first position to said second position.

16. The access structure of claim 14, said stress riser configuration including a stress point and stress riser segments radiating from said stress point.

17. The access structure of claim 16, further including a tamper indicating structure indicating a first access of said stress riser configuration through said attachment body.

18. The access structure of claim 14, further including a tamper indicating structure indicating a first access of said stress riser configuration through said attachment body.

* * * * *